United States Patent [19]

Chombart et al.

[11] Patent Number: 4,810,367

[45] Date of Patent: Mar. 7, 1989

[54] PROCESS FOR DEASPHALTING A HEAVY HYDROCARBON FEEDSTOCK

[75] Inventors: Didier Chombart, Paris; Francois X. Cormerais, Montivilliers; Michel Laborde, Sainte Foy Les Lyon, all of France

[73] Assignee: Compagnie de Raffinage et de Distribution Total France, Levallois-Perret, France

[21] Appl. No.: 50,912

[22] Filed: May 15, 1987

[30] Foreign Application Priority Data

May 15, 1986 [FR] France ..... 86 06994

[51] Int. Cl.[4] ..... C10C 1/18

[52] U.S. Cl. ..... 208/309; 208/45; 208/316; 210/726; 210/727

[58] Field of Search ..... 208/45, 316, 309; 210/727, 726

[56] References Cited

U.S. PATENT DOCUMENTS

| | | | |
|---|---|---|---|
| 2,940,920 | 6/1960 | Garwin | 208/45 |
| 2,943,050 | 6/1960 | Beavon | 208/309 |
| 3,364,138 | 1/1968 | Campagne et al. | 208/309 |
| 3,414,506 | 12/1968 | Campagne | 208/309 |
| 3,627,675 | 12/1971 | Ditman et al. | 208/309 |
| 3,830,732 | 8/1974 | Gatsis | 208/309 |
| 3,951,781 | 4/1976 | Owen et al. | 208/309 |
| 3,972,807 | 8/1976 | Uitti et al. | 208/309 |
| 3,981,797 | 9/1976 | Kellar et al. | 208/309 |
| 4,125,459 | 11/1978 | Garwin | 208/309 |
| 4,239,616 | 12/1980 | Gearhart | 208/309 |
| 4,278,529 | 7/1981 | Gearhart | 208/309 |
| 4,305,812 | 12/1981 | Shih et al. | 208/309 |
| 4,305,814 | 12/1981 | Leonard | 208/309 |
| 4,315,815 | 2/1982 | Gearhart | 208/309 |
| 4,421,639 | 12/1983 | Lambart | 208/309 |
| 4,548,711 | 10/1985 | Coombs et al. | 208/309 |
| 4,572,781 | 2/1986 | Krasuk et al. | 208/309 |
| 4,592,831 | 6/1986 | Rhoe et al. | 208/309 |

FOREIGN PATENT DOCUMENTS 1160186 5/1968 United Kingdom .

*Primary Examiner*—Curtis R. Davis
*Assistant Examiner*—Helane Myers
*Attorney, Agent, or Firm*—A. Thomas S. Safford

[57] ABSTRACT

A process for deasphalting a heavy hydrocarbon feedstock, comprising two stages of precipitation from the feedstock of an asphaltene fraction alone or, alternatively, of a resin fraction along with the asphaltene fraction, by means of a heavy solvent and a light solvent, respectively, is disclosed.

In accordance with the process, the heavy solvent and the light solvent both contain, in different proportions, at least one hydrocarbon having 3 carbon atoms and at least one hydrocarbon having at least 5 carbon atoms, the proportion of the hydrocarbon having 3 carbon atoms being higher in the light solvent than in the heavy solvent.

19 Claims, 3 Drawing Sheets

PROCESS FOR DEASPHALTING A HEAVY HYDROCARBON FEEDSTOCK

The present invention relates to a process for deasphalting a heavy hydrocarbon feedstock.

A heavy hydrocarbon feedstock within the meaning of the invention is a feedstock having a density above about 930 kg/m$^3$ and composed substantially of hydrocarbons but containing also other chemical compounds which have, in addition to carbon and hydrogen atoms, heteroatoms such as oxygen, nitrogen or sulfur, and metals such as vanadium or nickel.

This feedstock may consist in particular of a crude petroleum or of a heavy oil having said density.

The feedstock may also come from the fractionation or treatment of crude petroleum, of a heavy oil, of oil shales or even of coal. Thus it may be the residuum from vacuum distillation or the residuum from atmospheric distillation of the starting products cited above or, for example, of the products obtained by the thermal treatment of these starting products or of their distillation residua.

The trend in recent years has been to seek to upgrade the high-density hydrocarbonaceous products more and more, which was not the case before. The need to upgrade heavy products has become more pressing since it is anticipated that the demand for light products such as motor fuels will be increasing at a relatively faster pace than the demand for heavier products, such as the fuel oils.

The heaviest portion of heavy hydrocarbon feedstocks consists of a mixture of an oil phase and an asphaltic phase. One way of obtaining light products from the oil phase is to subject the latter to catalytic cracking. However, the catalytic cracking feedstock should not be too contaminated with metals and should not have too high a Conradson residue. It should be noted that the Conradson residue, which is indicative of the tendency of a product to coke, is determined in conformity with French standard AFNOR NFT 60-116.

As has been pointed out above, heavy hydrocarbon feedstocks contain compounds which have, in addition to hydrogen and carbon atoms, heteroatoms such as oxygen, nitrogen or sulfur as well as metals. Some of these compounds, and particularly those containing metals, are present especially in the asphaltic phase.

Two groups are customarily distinguished among the compounds which make up the asphaltic phase: the resins and the asphaltenes. Both the asphaltenes and the resins have polycyclic aromatic structures. Apart from aromatic rings, thiophene and pyridine rings are present. However, the resins have less-condensed structures than the asphaltenes and lower molecular weights.

The name "asphaltenes" is generally applied to compounds which are precipitated by the addition to the charge stock of a saturated aliphatic hydrocarbon having from 5 to 7 carbon atoms, such as pentane, hexane or heptane. Under standard AFNOR NFT 60-115, the asphaltene content of a product thus is determined by precipitation with normal heptane at boiling.

The resins precipitate at the same time as the asphaltenes when a hydrocarbon with a lower boiling point, for example, propane, is used. In fact, this is a conventional differentiation, and it is obvious that when a given solvent is employed at a given temperature to treat a feedstock, precipitation of asphaltene-type compounds can be obtained if the solvent and the temperature are appropriate. If the feedstock freed from the asphaltenes is then treated with the same solvent at a higher temperature, precipitation of the resins is obtained.

In the well-known deasphalting process, the oil phase and the asphaltic phase are separated by the operation which consists in extracting the oil phase from the residuum with a solvent. The solvent may be selected from the group comprising saturated or unsaturated aliphatic hydrocarbons having from 2 to 8 carbon atoms, alone or in admixture; mixtures of hydrocarbons known as distillates, with molecular weights close to those of hydrocarbons having from 2 to 8 carbon atoms; and mixtures of all of the hydrocarbons cited above.

Deasphalting can be carried out in a single stage, in which case an oil phase and an asphaltic phase are obtained, the latter containing both the asphaltenes and the resins. It can also be carried out in two stages, using two different solvents and/or different operating conditions in the two stages. (See U.S. Pat. Nos. 3,830,732 and 2,940,920, for example.) In the two-stage process, the oil phase, the resins and the asphaltenes are obtained separately.

U.S. Pat. No. 3,830,732 thus describes a process using two solvents, propane and pentane, which requires two completely separate solvent recovery units, and hence a substantial investment.

In the single-solvent process (see U.S. Pat. No. 2,940,920, for example), it is necessary, and difficult, to adjust the operating conditions of the two stages very precisely in order to obtain products with the desired qualities. With this process, it is even impossible at times to obtain both an oil phase that is suitable for use as a catalytic cracking feed and a very hard pitch that can be ground and used as a solid fuel.

The present invention utilizes a two-stage deasphalting process which uses in the two stages solvents between which there is both little difference in physical and chemical properties, which makes it possible to employ, at least in one embodiment, a single solvent stripping installation, yet sufficient difference in volatility and separability for obtaining both a "clean" oil phase of a quality perfectly suitable for use as catalytic cracking feed, without additional hydrogen treatment, and an asphaltene fraction that is sufficiently solid at ambient temperature to be ground and used as a solid fuel.

The asphaltene fraction therefore does not require an additional expenditure for a flux to be used in the liquid state.

The present invention thus seeks to prepare, particularly from a heavy hydrocarbon feedstock, a product that is suitable for use as catalytic cracking feed.

To this end, the invention has as a preferred embodiment a process for the deasphalting of a heavy feedstock which yields a deasphalted oil phase with a Conradson carbon value of 10 or less; a resin fraction; and an asphaltene fraction with a softening point of 150° C. or higher, said process comprising two stages of precipitation from the feedstock both of the asphaltene fraction alone and of the resin fraction, optionally along with the asphaltene fraction, with a heavy solvent and a light solvent, respectively, said process being characterized in that both the heavy solvent and the light solvent contain, in different proportions, at least one hydrocarbon having 3 carbon atoms and at least one hydrocarbon having at least 5 carbon atoms, the proportion of the hydrocarbon having 3 carbon atoms being higher in the light solvent than in the heavy solvent.

In view of the fact that the separation between the oil phase, the resins and the asphaltenes cannot be defined precisely from the chemical standpoint, in this object of the invention and hereafter in the present specification, 1. "oil phase" is intended to mean a phase from which has been eliminated practically the entire asphaltic phase, that is, the phase which is precipitated by the addition of a light solvent, as defined in the object of the invention, this oil phase having a Conradson residue of 10 or less (as determined in conformity with standard AFNOR NFT 60-116), and 2. "resin fraction" and "asphaltene fraction" are intended to mean the lightest fraction and the heaviest fraction, respectively, of the asphaltic phase, the boundary between these two fractions, within the meaning of the invention, being defined by the fact that the asphaltene fraction should have a softening point of 150° C. or higher (as determined in conformity with standard AFNOR NTF 66-008).

In the process of the invention, two solvents are used, a light solvent and a heavy solvent, which contain the same chemical compounds but in different proportions, which explains their different functions: The heavy solvent is capable of causing the asphaltene fraction to precipitate but solubilizes the resin fraction and, a fortiori, the oil phase, while the light solvent is capable of causing the precipitation of the resin fraction, and hence of the asphaltene fraction, of course, but solubilizes the oil fraction.

The two solvents contain at least one hydrocarbon having 3 carbon atoms (propane and/or propylene) and at least one saturated aliphatic or olefinic hydrocarbon having at least 5 carbon atoms (including, in particular, pentane, pentene, hexane, hexene, heptane, heptene).

The process is thus characterized by a search for selectivity, which leads to the combination of two solvents containing little or no hydrocarbon having 4 carbon atoms, for variation of the selectivity according to the stage involved.

The solvents may consist of a single hydrocarbon or of a mixture of hydrocarbons; thus, the heavy solvent may consist of a mixture of pentane and hexane, for example.

It should be noted that when a hydrocarbon, for example, pentane, is cited within this object and hereafter in the present specification, it may be either a well-defined hydrocarbon, such as normal pentane or, alternatively, as will be practically always the case industrially, a mixture of isomers of that hydrocarbon, such as, in the case of pentane, mainly normal pentane and isopentane.

The light solvent contains a larger proportion of hydrocarbon having 3 carbon atoms than the heavy solvent.

In general, the heavy solvent will preferably contain from 5 to 40 percent by volume of a hydrocarbon having 3 carbon atoms and from 60 to 95 volume percent of at least one hydrocarbon having at least 5 carbon atoms. The light solvent will preferably contain from 20 to 80 volume percent of a hydrocarbon having 3 carbon atoms and from 20 to 80 volume percent of at least one hydrocarbon having at least 5 carbon atoms.

The process in accordance with the invention may be carried out in two different ways:

In the first mode of carrying out the process of the invention, the first stage is the stage of separation of the asphaltene fraction by means of the heavy solvent.

At the end of this stage, there are recovered the asphaltene fraction containing some solvent, which is later removed, on the one hand and, in solution in the heavy solvent, the resin fraction and the oil phase on the other hand.

The resin fraction is then precipitated with a light solvent.

To obtain this light solvent in one particular embodiment, there is added to the mixture of heavy solvent, resin fraction and oil phase, in a second stage which is the stage of resin separation, a third solvent that is lighter than the light solvent, the latter thus resulting from the combination of heavy solvent and said third solvent. At the end of this stage, there are recovered the resin fraction containing some solvent, which is later removed, on the one hand and the oil phase in solution in the light solvent on the other hand.

This solution is then subjected to a treatment that makes it possible to obtain said third solvent, which is recycled to the second stage, and a solution of the oil phase in the heavy solvent, from which it is separated conventionally, the heavy solvent being recycled to the first stage.

The treatment of the solution of the oil phase in the light solvent may consist, in particular, of heating said solution to vaporize preferentially the hydrocarbon having 3 carbon atoms.

Instead of being heated, said solution may be vacuum flashed.

In the first stage of this first mode of carrying out the process of the invention, the heavy solvent will preferably contain from 10 to 40 percent by volume of a hydrocarbon having 3 carbon atoms and from 60 to 90 volume percent of at least one hydrocarbon having at least 5 carbon atoms, and, better yet, from 15 to 35 volume percent of a hydrocarbon having 3 carbon atoms and from 65 to 85 volume percent of at least one hydrocarbon having at least 5 carbon atoms.

In the second stage of this first mode of carrying out the process of the invention, the light solvent will preferably contain from 20 to 80 percent by volume of a hydrocarbon having 3 carbon atoms and from 20 to 80 volume percent of at least one hydrocarbon having at least 5 carbon atoms, and, better yet, from 25 to 75 volume percent of a hydrocarbon having 3 carbon atoms and from 25 to 75 volume percent of at least one hydrocarbon having at least 5 carbon atoms.

In the second mode of carrying out the process of the invention, the first stage is a stage of simultaneous precipitation of the resin and asphaltene fractions with the light solvent obtained by combining in this stage the heavy solvent and a third solvent that is lighter than the light solvent desired. At the end of this first stage, there are obtained a mixture of the resin and asphaltene fractions on the one hand and, on the other hand, the oil phase in solution in the light solvent, from which it is later separated.

In a second stage, heavy solvent which solubilizes the resin fraction is added to the mixture of the resin and asphaltene fractions. At the end of this second stage there are obtained the asphaltene fraction containing some solvent, which is later removed, and the resin fraction in solution in the heavy solvent, from which it is later separated.

In the first stage of this second mode of carrying out the process of the invention, the light solvent will preferably contain from 20 to 80 percent by volume of a hydrocarbon having 3 carbon atoms and from 20 to 80 volume percent of at least one hydrocarbon having at least 5 carbon atoms, and, better yet, from 30 to 70 volume percent of at least one hydrocarbon having 3 carbon atoms and from 30 to 70 volume percent of at least one hydrocarbon having at least 5 carbon atoms.

In the second stage of this second mode of carrying out the process of the invention, the heavy solvent will preferably contain from 5 to 30 percent by volume of a hydrocarbon having 3 carbon atoms and from 70 to 95 volume percent of at least one hydrocarbon having at least 5 carbon atoms, and, better yet, from 10 to 25 volume percent of a hydrocarbon having 3 carbon atoms and from 75 to 90 volume percent of at least one hydrocarbon having at least 5 carbon atoms.

The operating conditions in the deasphalting stages may be as follows:

Pressure ranging from $20 \cdot 10_5$ to 1.107 pascals abs.

Temperature ranging from 100° to 300° C.

Mass ratio of solvent to fraction to be deasphalted ranging from 1 to 10.

These conditions will vary, of course, depending on the nature of the feedstock and on the nature of the solvents employed.

A better understanding of the invention will be provided by the detailed description which follows, with reference to the accompanying drawings, which are not limitative, and wherein.

Figure 1:
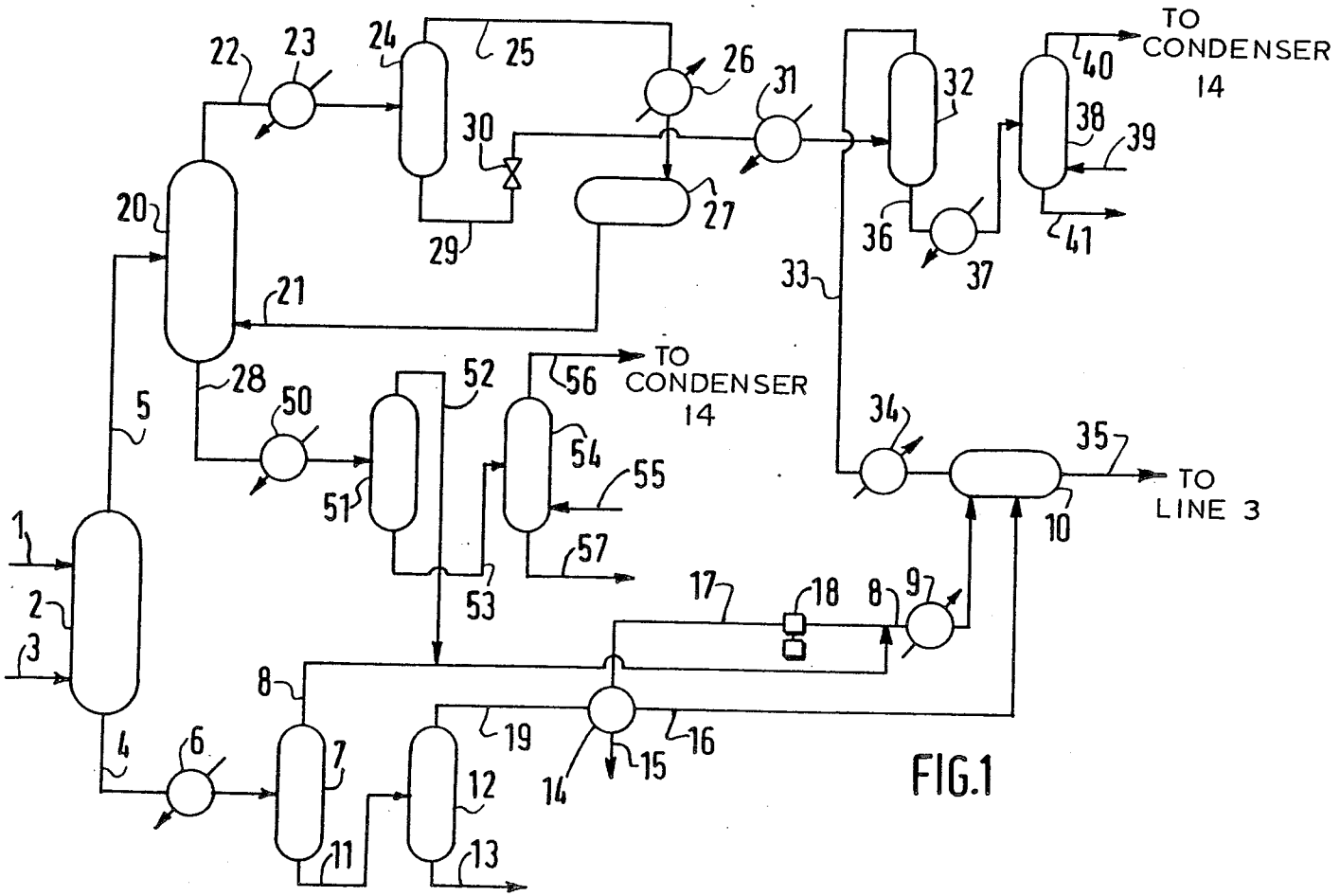
FIGS. 1 and 2 are diagrams of two units for implementing the first and second modes, respectively, of carrying out the process of the invention.

With reference to FIG. 1, which shows a unit for implementing the first mode of carrying out the process of the invention, the heavy hydrocarbon feedstock to be deasphalted is introduced by way of line 1 into the upper part of a first extraction tower 2. A heavy solvent, whose source will be explained further on, is further introduced into the bottom of tower 2 through a line 3.

The same heavy solvent may also be added to the feedstock in line 1 through a line which is not shown.

The heavy solvent in line 3 and the operating conditions of tower 2 are selected so that only the asphaltene fraction of the feedstock 1, whose softening point is 150° C. or higher, precipitates in said tower.

The pressure in the interior of tower 2 may range from $20 \cdot 10^5$ to $1 \cdot 10^7$ pascals abs and the temperature from 100° to 200° C., and the mass ratio of heavy solvent to feedstock may range from 1 to 10; however, these values be regarded as limits.

For example, in the case of a $C_3$-20/$C_5$-80 heavy solvent, that is, one containing 20 volume percent propane and 80 volume percent pentane, the pressure may be about $40 \cdot 10^5$ pascals abs, the temperatures at the bottom and at the top of tower 2 being about 100° C. and 140° C., respectively, and the mass ratio of heavy solvent to feedstock being about 2/1.

The asphaltene fraction containing some heavy solvent is recovered at the bottom of tower 2 through line 4.

At the top of tower 2, through line 5, the feedstock which has been freed from the asphaltene fraction is recovered in solution in the major portion of the heavy solvent introduced into tower 2

After passing into at least one heater 6, the fraction recovered by way of line 4 is piped to a flash tower 7 which, in the case of a $C_3$-20/$C_5$-80 heavy solvent, is operated at a temperature of about 300° C. and a pressure of about $5 \cdot 10^5$ pascals abs. Heavy solvent is recovered at the top of tower 7 through line 8 and, after passing through a cooler 9, conducted to a vessel 10.

The vessel 10 is used to store heavy solvent. In the case of a $C_3$-20/$C_5$-80 heavy solvent, the temperature in vessel 10 is about 60° C. and the pressure about $5 \cdot 10^5$ pascals abs.

The asphaltene fraction is recovered at the bottom of tower 7 by way of line 11 and conveyed to a tower 12 which, in the case of a $C_3$-20/$C_5$-80 heavy solvent, is operated at a temperature of about 300° C. and a pressure of about 0.5·105 pascals abs.

The asphaltene fraction that has been freed from heavy solvent is collected at the bottom of tower 12 through line 13. This fraction may be used as a solid fuel after grinding.

At the top of tower 12, solvent is withdrawn by way of line 19 and piped to a condenser 14.

At the outlet of condenser 14, water (the source of which will be explained further on) is withdrawn through line 15 and discharged, and, in the case of a $C_3$-20/$C_5$-80 heavy solvent, the hydrocarbon or hydrocarbons having at least 5 carbon atoms is or are recovered through line 16 and conducted to vessel 10, and the hydrocarbon having 3 carbon atoms is recovered through line 17 and, after passing through a compressor 18, flows through line 8, and hence to vessel 10.

The mixture of heavy solvent and feedstock freed from the asphaltene fraction, recovered by way of line 5, is conveyed to a second extraction tower 20. Through line 21, a third solvent is introduced into tower 20 so that in the latter the extraction is carried out by means of a light solvent which results from the combination of the heavy solvent and of the third solvent, and wherein the proportion of the hydrocarbon having 3 carbon atoms is higher than that of the heavy solvent.

In the case of a $C_3$-20/$C_5$-80 heavy solvent, the third solvent may thus be a $C_3$-40/$C_5$-60 solvent, that is, one containing 40 volume percent propane and 60 volume percent pentane, the light solvent then being a $C_3$-30/$C_5$-70 solvent containing 30 volume percent propane and 70 volume percent pentane.

The operating conditions in the interior of tower 20 are such that the resin fraction precipitates.

The pressure in the interior of tower 20 may range from $20 \cdot 10^5$ to $1 \cdot 10^7$ pascals abs and the temperature from 100° to 300° C., the mass ratio of light solvent to charge stock of tower 2 ranging from 1 to 10; however, these values should not be regarded as limits.

For example, in the case of a $C_3$-30/$C_5$-70 light solvent, the pressure may be about $40 \cdot 10^5$ pascals abs, and the temperatures at the bottom and top of tower 20 about 110° C. and 150° C., respectively, the volume ratio of light solvent to charge stock of tower 2 being about 4/1.

At the top of tower 20, a mixture of deasphalted oil phase and light solvent is recovered through line 22.

At the bottom of tower 20, the resin fraction containing some light solvent is recovered through line 28.

After passing through a heater 23, the mixture of deasphalted oil phase and light solvent recovered through line 22 is piped to a flash tower 24 which, in the case of a $C_3$-30/$C_5$-70 light solvent, is operated at a pressure of about $25 \cdot 10^5$ pascals abs and a temperature of about 150° C. As a result of the passage through heater 23, a portion of the solvent is vaporized, the hydrocarbon having 3 carbon atoms being preferentially vaporized. Consequently, a third solvent enriched in hydrocarbon having 3 carbon atoms is recovered at the top of tower 24 through line 25. In the case of a $C_3$-30/$C_5$-70 light solvent, a third, $C_3$-40/$C_5$-60 solvent is so obtained.

If necessary, plates may be installed in the interior of this tower to improve separation.

After passing through a cooler 26, the third solvent recovered through line 25 is conveyed to a storage vessel 27. In the case of a $C_3$-40/$C_5$-60 third solvent, the temperature in the interior of vessel 27 will be about 110° C., and the pressure about 25 bars.

The third solvent is then recycled to tower 20 through line 21.

At the bottom of tower 24, a mixture of deasphalted oil and heavy solvent is recovered by way of line 29 and, after passing through a relief valve 30, where its pressure and temperature are reduced (in the case of a $C_3$-20/$C_5$-80 heavy solvent to about $5 \cdot 10^5$ pascals abs and 100° C., respectively), and passing through a heater 31, piped to a flash tower 32 which, in the case of a $C_3$-20/$C_5$-80 heavy solvent, is operated at a pressure of about $5 \cdot 10^5$ pascals abs and a temperature of about 130° C.

The major portion of the heavy solvent is recovered at the top of tower 32 by way of line 33 and, after passing through a cooler 34, piped to vessel 10.

Vessel 10 is connected through a line 35 to line 3 and the heavy solvent can therefore be recycled to tower 2.

The deasphalted oil phase which still contains some solvent is withdrawn at the bottom of tower 32 through a line 36 and, after passing through a heater 37, conducted to a steam stripping tower 38, into which steam is introduced through a line 39.

In the case of a $C_3$-20/$C_5$-80 heavy solvent, this tower is operated at a pressure of about $1.5 \cdot 10^5$ pascals abs and a temperature of about 250° C.

The deasphalted oil is recovered at the bottom of tower 38 through line 41 and water and solvent are withdrawn at the top of that tower through line 40 and piped to condenser 14.

After passing through a heater 50, the resin fraction containing some light solvent which has been recovered through line 28 from the bottom of tower 20 is conducted to a flash tower 51 which, in the case of a $C_3$-30/$C_5$-70 light solvent, is operated at a pressure of about $5 \cdot 10^5$ pascals abs and a temperature of about 280° C.

Some light solvent is recovered at the top of tower 1 through a line 52 and piped to line 8.

The resin fraction which still contains some solvent collected from the bottom of tower 51 through a line 53 is conducted to a steam stripping tower 54, into which steam is introduced through a line 55.

The resin fraction recovered at the bottom of tower 54 through line 57 may be used as a fuel-oil base, or incorporated into bitumens, or serve as an excellent visbreaker feed.

Water and solvent are withdrawn from the top of tower 54 through a line 56 and piped to condenser 14.

It should be noted that when heavy solvent is introduced into vessel 10 through line 33, light solvent coming from lines 52 and 56 is also introduced. All of this is recycled as heavy solvent. The amount of light solvent actually is very low in relation to the heavy solvent, and all that need to be done to obtain a heavy solvent of the proper composition is to add a little hydrocarbon having at least 5 carbon atoms to vessel 10.

In the units shown in FIG. 1, as well as in FIGS. 2 and 3 which will now be described, solvent make-up (not shown) is of course provided to compensate for solvent losses.

Figure 2:
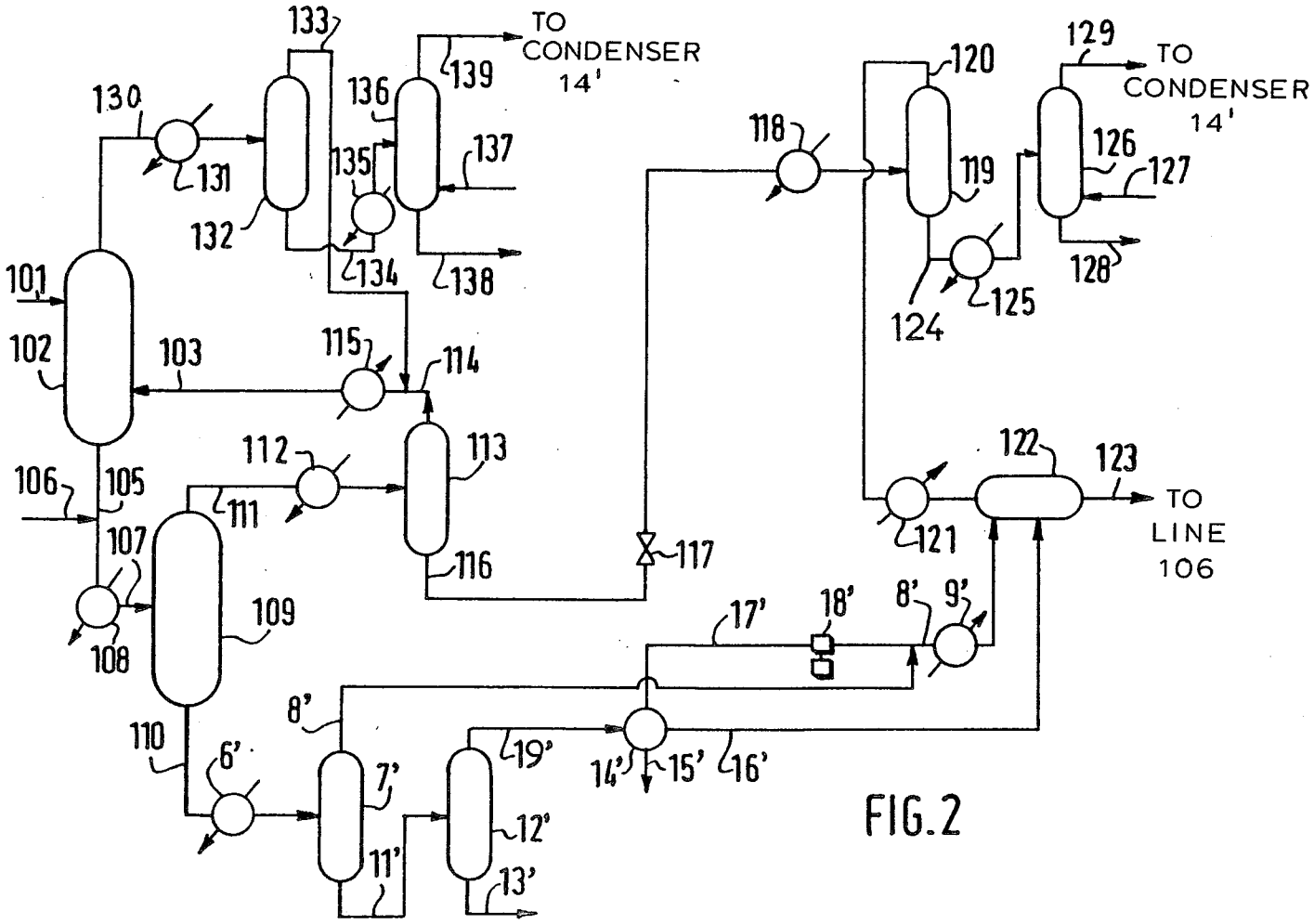

With reference to FIG. 2, which shows a unit for implementing the second mode of carrying out the process of the invention, the heavy hydrocarbon feedstock to be deasphalted is introduced by way of line 101 into the upper part of a first extraction tower 102. A light solvent, whose source will be explained further on, is further introduced into the bottom of tower 102 through a line 103. The resin and asphaltene fractions precipitate.

The light solvent may be a $C_3$-60/$C_5$-40 solvent, for example, containing 60 volume percent propane and 40 volume percent pentane.

The pressure in the interior of tower 102 may range from $20 \cdot 10^5$ to $1 \cdot 10^7$ pascals abs and the temperature from 100° to 300° C., and the mass ratio of light solvent to feedstock may range from 1 to 10; however, these values should not be regarded as limits.

For example, in the case of a $C_3$-60/$C_5$-40 light solvent, the pressure may be about $40 \cdot 10^5$ pascals abs, the temperatures at the bottom and top of tower 102 being 100° C. and 130° C., respectively, and the mass ratio of light solvent to feedstock of tower 102 being about 2/1.

From the bottom of tower 102, through line 105, all of the asphaltic phase containing the asphaltene and resin fractions and some light solvent is withdrawn. To this mixture there is added, through line 106, a solvent whose source will be explained further on. This solvent contains little hydrocarbon having 3 carbon atoms. After passing through a heater 108, this new mixture is piped through line 107 to a second extraction tower 109, where the extraction is effected in the presence of a heavy solvent, owing to the mixture of solvents from lines 105 and 106.

The solvent and the operating conditions of tower 109 are selected so that only the asphaltene fraction from line 105, whose softening point is 150° C. or higher, precipitates in that tower.

When the light solvent is a $C_3$-60/$C_5$-40 solvent, the heavy solvent may be a $C_3$-20/$C_5$-80 solvent, the solvent in line 106 being a $C_3$-10/$C_5$-90 solvent The pressure in the interior of tower 109 may range from $20 \cdot 10^5$ to $1 \cdot 10^5$ pascals abs and the temperature from 100° to 200° C., and the mass ratio of heavy solvent to feedstock of tower 102 may range from 1 to 10; however, these values should not be regarded as limits.

For example, in the case of a $C_3$-20/$C_5$-80 heavy solvent, the pressure may be about $40 \cdot 10^5$ pascals abs, the temperatures at the bottom and top of tower 109 being 100° C. and 140° C., respectively, and the mass ratio of heavy solvent to feedstock of tower 102 being about 2/1.

From the bottom of tower 109, through line 110, the asphaltene fraction containing some heavy solvent is withdrawn.

The treatment of this fraction is the same as that of the unit of FIG. 1. For the sake of simplicity, it will not be described. This part of the unit that is identical with that of FIG. 1 is shown in the same manner, the reference numerals of the equipment items being primed.

From the top of tower 109, through line 111, a mixture of resin fraction and heavy solvent is withdrawn.

After passing through a heater 112, the mixture of resin fraction and heavy solvent withdrawn through line 111 is piped to a flash tower 113 which, in the case of a $C_3$-20/$C_5$-80 heavy solvent, is operated at a pressure of about 25 .$10^5$ pascals abs and a temperature of about 150° C. As a result of the passage through heater 112, a portion of the solvent is vaporized, the hydrocarbon having 3 carbon atoms being preferentially vaporized. Consequently, $C_3$-60/$C_5$-40 light solvent is recovered at the top of tower 113 through line 114 and, after passing through a cooler 115, recycled to line 103 to replenish the light solvent flowing in line 105.

The installation of plates in the interior of tower 113 will permit separation to be improved, if need be.

From the bottom of tower 113, through line 116, a mixture of resins and of a solvent that is heavier than the heavy solvent is withdrawn and, after being passed through a relief valve 117, where its pressure and temperature are reduced (in the case of $C_3$-10/$C_5$-90 solvent to about $5 \cdot 10^5$ pascals abs and 120° C., respectively), and through a heater 118, piped to a flash tower 119 which, in the case of a $C_3$-10/$C_5$-90 solvent, is operated at a pressure of about $5 \cdot 10^5$ pascals abs and a temperature of about 140° C.

The major portion of the solvent is recovered at the top of tower 119 by way of line 120 and, after passing through a cooler 121, piped to a vessel 122.

Vessel 122 is connected through a line 123 to line 106, and the solvent can therefore be recycled.

The resin phase which still contains some solvent is withdrawn at the bottom of tower 119 through a line 124 and, after passing through a heater 125, conducted to a steam stripping tower 126, into which steam is introduced through a line 127.

In the case of a $C_3$-10/$C_5$-90 solvent, this tower is operated at a pressure of about $1.5 \cdot 10^5$ pascals abs and a temperature of about 280° C.

The resins are recovered at the bottom of tower 126 through a line 128, and water and solvent are are withdrawn at the top of that tower through a line 129 and piped to condenser 14'.

A mixture of deasphalted oil and light solvent is recovered from the top of tower 102 through line 130 and, after passing through a heater 131, conducted to a flash tower 132 which, in the case of a $C_3$-60/$C_5$-40 light solvent, is operated at a pressure of about $25 \cdot 10^5$ pascals abs and a temperature of about 140° C.

The major portion of the light solvent is recovered from the top of tower 132 through line 133 and recycled to line 103 by way of line 114 and cooler 115.

The deasphalted oil which still contains some solvent is recovered from the bottom of tower 132 through line 134 and, after passing through heater 135, conducted to a steam stripping tower 136, into which steam is introduced through a line 137.

In the case of a $C_3$-60/$C_5$-40 light solvent, that tower is operated at a pressure of about $1.5 \cdot 10^5$ pascals abs and a temperature of about 250° C.

The deasphalted oil is recovered at the bottom of tower 136 through line 138, and water and solvent are withdrawn at the top of that tower through line 139 and piped to condenser 14'.

Figure 3:
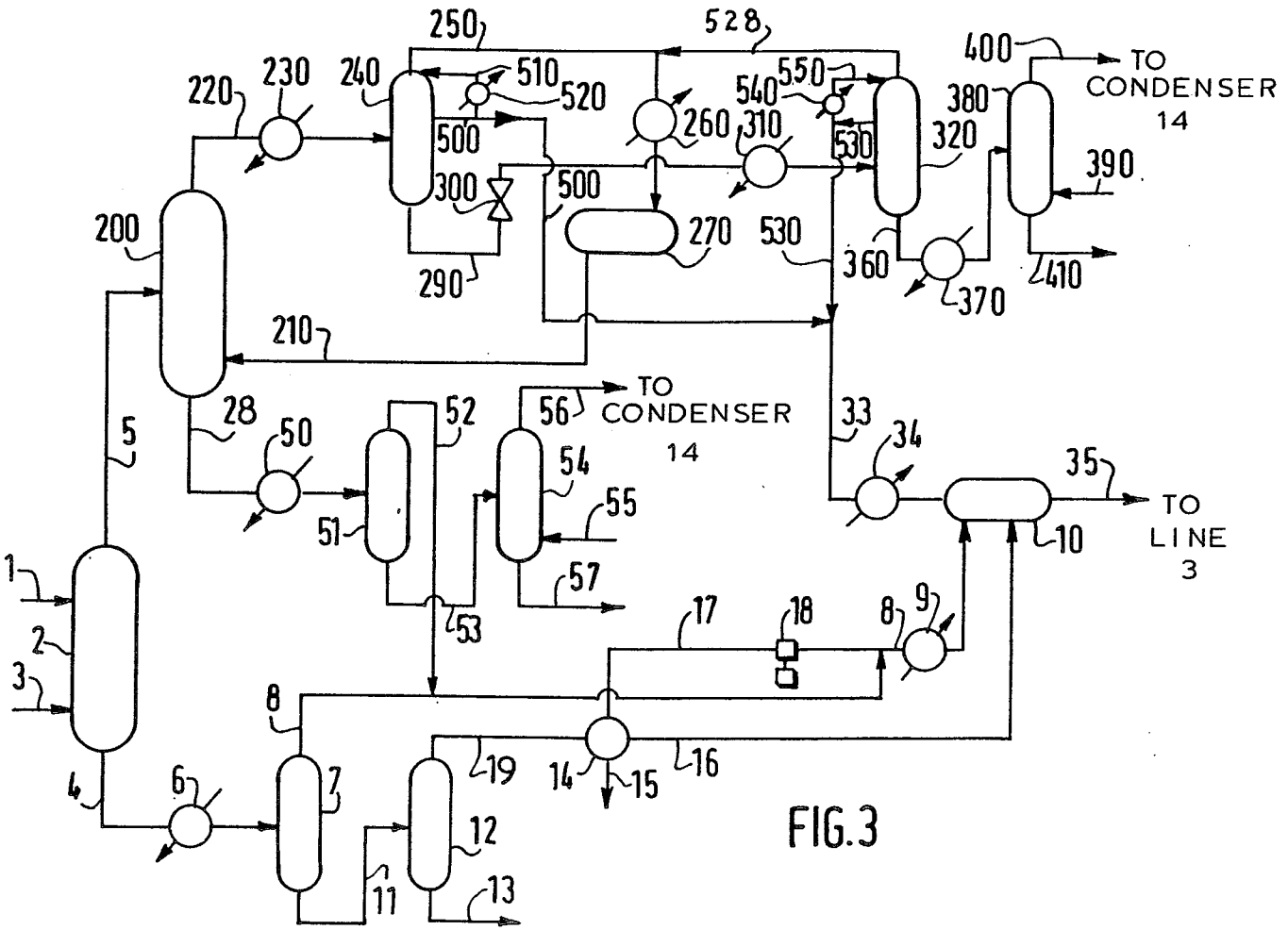
FIG. 3 illustrates an alternative for carrying out the process of FIG. 1.

FIG. 3 illustrates an alternative to FIG. 1 in which the separation of the light solvent from the deasphalted oil is effected in such a way that the light solvent contains still more hydrocarbon having 3 carbon atoms. The separation of the resins from the oil is improved and makes it possible to obtain a deasphalted oil that is still "cleaner", that is, has an even lower Conradson residue.

To describe this figure, a $C_3$-20/$C_5$-80 heavy solvent and a $C_3$-35/$C_6$-65 light solvent will be taken as an example; however, this example of a pair of solvents should not, of course, be construed as limitative.

Only the portion of FIG. 3 which differs from FIG. 1 will be described, and only the equipment items holding different products than or differing themselves from the equipment items of FIG. 1 are renumbered, with the other elements retaining the same reference numerals.

The mixture of $C_3$-20/$C_5$-80 heavy solvent and feedstock containing no longer any asphaltenes which has been recovered through line 5 is piped to a second extraction tower 200. A third, $C_3$-50/$C_5$-50 solvent is fed to that tower by way of a line 210, the extraction being actually effected with a $C_3$-35/$C_5$-65 light solvent. The pressure inside the tower may be about $40 \cdot 10^5$ pascals abs, the temperature at the bottom and top of tower 200 being about 115° C. and 145° C., respectively, and the mass ratio of light solvent to feedstock of tower 2 being about 4/1.

The mixture of deasphalted oil phase and $C_3$-35/$C_5$-65 light solvent is recovered at the top of tower 200 through a line 220.

The resin fraction containing some solvent is withdrawn from the bottom of tower 200 through line 28 and treated in the same manner as in FIG. 1. After passing through a heater 230, the mixture of deasphalted oil phase and $C_3$-35/$C_5$-65 light solvent is piped to a flash tower 240 which, in the case of the $C_3$-35/$C_5$-65 light solvent, is operated at a pressure of $25 \cdot 10^5$ pascals abs and a temperature of 145° C.

Tower 240 is provided with three take-off points. As a result of the partial vaporization of the hydrocarbon having 3 carbon atoms, there are recovered:

From the bottom of the tower, through a line 290, a mixture of deasphalted oil and $C_3$-20/$C_5$-80 solvent which, after passing through a relief valve 300, where its pressure and temperature are reduced to $5 \cdot 10^5$ pascals abs and 95° C., respectively, and through a heater 310, is piped to a flash tower 320 operated at a pressure of $5 \cdot 10^5$ pascals abs and a temperature of about 120° C.;

through a side take-off 500, a $C_3$-30/$C_5$-70 solvent, one portion of which is piped to line 33 while the other portion is recycled to tower 240 through a line 510 after passing through a cooler 520; and from the top of tower 240, through line 250, a $C_3$-50/$C_5$-50 solvent which, after passing through a cooler 260, is piped to a storage vessel 270, this solvent then being recycled to tower 200 through line 210.

Tower 320 is provided with three take-off points:

From the top of this tower, there is recovered, through a line 528, $C_3$-50/$C_5$-50 solvent, which is recycled to line 250;

through a side take-off 530, there is recovered a $C_3$-15/$C_5$-85 solvent, one portion of which is piped to line 33 while the other portion is recycled to tower 320 through a line 550 after passing through a cooler 540; and from the bottom of tower 320, the deasphalted oil phase containing some solvent is recovered through a line 360.

As in the case of FIG. 1, for removal of the solvent from the oil phase in line 360, that phase, after passing through a heater 370, is piped to a steam stripping tower 380, into which steam is introduced through a line 390.

The deasphalted oil is recovered at the bottom of tower 380 through a line 410, and water and solvent are withdrawn at the top of that tower through a line 400 and piper to condenser 14.

The combination of the solvents from lines 500 and 530 makes it possible to obtain a $C_3$-20/$C_5$-80 heavy solvent, which is recycled from vessel 10 through line 3.

As is apparent from this description of FIG. 3, the two side take-offs of towers 240 and 320 permit the light solvent to be enriched in hydrocarbon having 3 carbon atoms.

As the examples which follow will show, the process in accordance with the invention is particularly useful for the simultaneous preparation of a deasphalted oil suitable for use as catalytic cracking feedstock with a Conradson residue of 10 or less, and preferably of 9 or less, and, better still, of 8 or less, and of an asphaltene fraction having a softening point of 150° C. or higher, and preferably of 160° C. or higher, and, better still, of 170° C. or higher.

These examples are intended to illustrate the invention in a nonlimitative manner.

References throughout to French standards designated by AFNOR NFT are to standardized test procedures similar to U.S. ASTM tests.

EXAMPLE 1

This example relates to the treatment of a hydrocarbon feedstock consisting of the vacuum-distillation residuum of the atmospheric-distillation residuum of a crude petroleum originating in Safaniya.

The characteristics of this feedstock are as follows:

| | |
|---|---|
| Density at 15° C.: (determined in conformity with standard AFNOR NFT 60-101) | 1,035 kg/m$^3$ |
| Viscosity at 100° C.: (determined in conformity with standard AFNOR NFT 60-100) | $0.56 \cdot 10^{-2}$ m$^2$/s |
| Conradson residue: (determined in conformity with standard AFNOR NFT 60-116) | 23 wt. % |
| Asphaltene content: (determined in conformity with standard AFNOR NFT 60-115) | 16 wt. % |
| Sulfur content: (determined by x-ray fluorescence) | 5.5 wt. % |
| Nickel content: (determined by x-ray fluorescence) | 43 ppm |
| Vanadium content: (determined by x-ray fluorescence) | 138 ppm |

This feedstock is treated in a unit for carrying out the process of the invention of the type shown in FIG. 1.

In that unit, $C_3$–$C_5$ solvents are used which have the compositions given in Table 1 which follows.

TABLE 1

| | Composition in percent by volume | | |
|---|---|---|---|
| | Heavy solvent | Light solvent | Third solvent |
| Propane | 20 | 30 | 40 |
| Butanes | 0.8 | 0.9 | 1 |
| n-Pentane | 63 | 55 | 47 |
| Isopentane | 16 | 14 | 12 |
| Hexanes | 0.2 | 0.1 | Traces |

The operating conditions are given in Table 2 below.

TABLE 2

| | Tower 2 | Tower 20 |
|---|---|---|
| Pressure (in $10^5$ pascals abs) | 40 | 40 |
| Temperature at the top (°C.) | 140 | 155 |
| Temperature at the bottom (°C.) | 110 | 120 |
| Mass ratio of solvent to feedstock line 1 | 2/1 | 4/1 |

The final balance obtained after separation of the solvent from the various products is given in Table 3 which follows.

TABLE 3

| | |
|---|---|
| Feedstock Line 1 (tons/day) | 2,500 |
| Resins produced Line 57 (tons/day) | 550 |
| Deasphalted oil produced Line 41 (tons/day) | 1,100 |
| Asphaltenes produced Line 13 (tons/day) | 850 |

The characteristics of the products obtained are given in Table 4 below.

TABLE 4

| Product | Characteristics | |
|---|---|---|
| Deasphalted oil | Density (kg/m$^3$) | 960 |
| | Viscosity at 100° C. ($10^{-6}$ m$^2$/s) | 80 |
| | Conradson residue (wt. %) | 5.8 |
| | Nickel (ppm) | 4 |
| | Vanadium (ppm) | 10 |
| | Asphaltenes (wt. %) | Traces |
| Resins | Density (kg/cm$^3$) | 1,042 |
| | Viscosity at 100° C. ($10^{-6}$ m$^2$/s) | 3,200 |
| | Conradson residue (wt. %) | 20 |
| | Softening point (°C.) | 50 |
| Asphaltenes | Density (kg/m$^3$) | 1,147 |
| | Softening point (°C.) | 169 |
| | Conradson residue (wt. %) | 47 |

It is readily apparent from this table that the process of the invention is advantageous inasmuch as it yields very hard asphaltenes and an oil suitable for use as a catalytic cracking feedstock since it has a Conradson residue of less than 8.

EXAMPLE 2

This example relates to the treatment of a hydrocarbon feedstock consisting of the effluent from the visbreaking of a residuum from vacuum distillation of a Safaniya crude petroleum.

The characteristics of this feedstock are as follows:

| | |
|---|---|
| Density at 15° C.: (determined in conformity with standard AFNOR NFT 60-101) | 1,060 kg/m$^3$ |
| Viscosity at 100° C.: (determined in conformity with standard AFNOR NFT 60-100) | $0.17 \cdot 10^{-2}$ m$^2$/s |
| Conradson residue: (determined in conformity with standard AFNOR NFT 60-116) | 27 wt. % |
| Asphaltene content: (determined in conformity with standard AFNOR NFT 60-115) | 22 wt. % |
| Sulfur content: (determined by x-ray fluorescence) | 6.2 wt. % |
| Nickel content: | 53 ppm |

-continued

| | |
|---|---|
| (determined by x-ray fluorescence) | |
| Vanadium: | 175 ppm |
| (determined by x-ray fluorescence) | |

This feedstock is treated in a unit for carrying out the process of the invention of the type shown in FIG. 1.

In that unit, $C_3$–$C_5$ solvents are used whose compositions are the same as those of the solvents of Example 1.

The operating conditions are given in Table 5 below.

TABLE 5

| | Tower 2 | Tower 20 |
|---|---|---|
| Pressure (in $10^5$ pascals abs) | 40 | 40 |
| Temperature at top (°C.) | 138 | 148 |
| Temperature at bottom (°C.) | 108 | 118 |
| Mass ratio of solvent to feedstock line 1 | 1.2/1 | 2.5/1 |

The final balance obtained after separation of the solvent from the various products is given in Table 6 below.

TABLE 6

| | |
|---|---|
| Feedstock Line 1 (tons/day) | 2,500 |
| Resins produced Line 57 (tons/day) | 350 |
| Deasphalted oil produced Line 41 (tons/day) | 1,250 |
| Asphaltenes produced Line 13 (tons/day) | 900 |

The characteristics of the products obtained are given in Table 7 which follows.

TABLE 7

| Product | Characteristics | |
|---|---|---|
| Deasphalted oil | Density (kg/m$^3$) | 972 |
| | Viscosity at 100° C. ($10^{-6}$ m$^2$/s) | 30 |
| | Conradson residue (wt. %) | 6.3 |
| | Nickel (ppm) | 3 |
| | Vanadium (ppm) | 8 |
| | Asphaltenes (wt. %) | Traces |
| Resins | Density (kg/m$^3$) | 1,112 |
| | Viscosity at 200° C. ($10^{-6}$ m$^2$/s) | 106 |
| | Conradson residue (wt. %) | 42 |
| | Softening point (°C.) | 97 |
| Asphaltenes | Density (kg/m$^3$) | 1,190 |
| | Softening point (°C.) | 178 |
| | Conradson residue (wt. %) | 51 |

It is readily apparent from this table that the process of the invention is advantageous inasmuch as it yields very hard asphaltenes and an oil suitable for use as a catalytic cracking feedstock since it has a Conradson residue of less than 8.

EXAMPLE 3

This example relates to the treatment of a hydrocarbon feedstock consisting of the residuum from vacuum distillation of the residuum from atmospheric distillation of a crude petroleum orginating in Iraq.

The characteristics of this feedstock are as follows:

| | |
|---|---|
| Density at 15° C.: (determined in conformity with standard AFNOR NFT 60-101) | 1,016 kg/m$^3$ |
| Viscosity at 100° C.: (determined in conformity with standard AFNOR NFT 60-100) | 900 $10^{-6}$ m$^2$/s |
| Conradson residue: (determined in conformity with standard AFNOR NFT 60-116) | 17 wt. % |
| Asphaltene content: (determined in conformity with standard AFNOR NFT 60-115) | 6 wt. % |
| Sulfur content: (determined by x-ray fluorescence) | 4.9 wt. % |
| Nickel content: (determined by x-ray fluorescence) | 43 ppm |
| Vanadium content: (determined by x-ray fluorescence) | 102 ppm |

This feedstock is treated in a unit for carrying out the process of the invention of the type shown in FIG. 1.

In that unit, $C_3$–$C_5$ solvents are used which have the compositions given in Table 8 below.

TABLE 8

| | Composition in percent by volume | | |
|---|---|---|---|
| | Heavy solvent | Light solvent | Third solvent |
| Propane | 30 | 50 | 70 |
| Butane | 1 | 1.5 | 2 |
| n-Hexane | 55 | 38 | 21 |
| Isohexane | 14 | 10.5 | 7 |

The operating conditions are given in Table 9 below.

TABLE 9

| | Tower 2 | Tower 20 |
|---|---|---|
| Pressure (in $10^5$ pascals abs) | 40 | 40 |
| Temperature at top (°C.) | 150 | 160 |
| Temperature at bottom (°C.) | 120 | 130 |
| Mass ratio of solvent to feedstock line 1 | 2/1 | 4/1 |

The final balance obtained after separation of the solvent from the various products is given in Table 10 below.

TABLE 10

| | |
|---|---|
| Feedstock Line 1 (tons/day) | 2,500 |
| Resins produced Line 57 (tons/day) | 650 |
| Deasphalted oil produced Line 41 (tons/day) | 1,450 |
| Asphaltenes produced Line 13 (tons/day) | 400 |

The characteristics of the products obtained are given in Table 11 which follows.

TABLE 11

| Product | Characteristics | |
|---|---|---|
| Deasphalted oil | Density (kg/m$^3$) | 955 |
| | Viscosity at 100° C. ($10^{-6}$ m$^2$/s) | 75 |
| | Conradson residue (wt. %) | 6.1 |
| | Nickel (ppm) | 2 |
| | Vanadium (ppm) | 4 |
| | Asphaltenes (wt. %) | Traces |

TABLE 11-continued

| Product | Characteristics | |
|---|---|---|
| Resins | Density (kg/m$^3$) | 1,080 |
| | Viscosity at 100° C. ($10^{-6}$ m$^2$/s) | Not determined |
| | Conradson residue (wt. %) | 27 |
| | Softening point (°C.) | 100 |
| Asphaltenes | Density (kg/m$^3$) | 1,174 |
| | Softening point (°C.) | 200 |
| | Conradson residue (wt. %) | 41 |

It is readily apparent from this table that the process of the invention is advantageous inasmuch as it yields very hard asphaltenes and an oil suitable for use as a catalytic cracking feedstock since it has a Conradson residue of less than 8.

EXAMPLE 4

This example relates to the treatment of a hydrocarbon feedstock consisting of the residuum from vacuum distillation of the residuum from atmospheric distillation of a crude petroleum originating in Safaniya.

The characteristics of this feedstock are as follows:

| | |
|---|---|
| Density at 15° C.: (determined in conformity with standard AFNOR NFT 60-101) | 1,035 kg/m$^3$ |
| Viscosity at 100° C.: (determined in conformity with standard AFNOR NFT 60-100) | 5,600 $10^{-6}$ m$^2$/s |
| Conradson residue: (determined in conformity with standard AFNOR NFT 60-116) | 23 wt. % |
| Asphaltene content: (determined in conformity with standard AFNOR NFT 60-115) | 16 wt. % |
| Sulfur content: (determined by x-ray fluorescence) | 5.5 wt. % |
| Nickel content: (determined by x-ray fluorescence) | 43 ppm |
| Vanadium content: (determined by x-ray fluorescence) | 138 ppm |

This feedstock is treated in a unit for carrying out the process of the invention of the type shown in FIG. 2.

In that unit, $C_3$–$C_5$ solvents are used which have the compositions given in Table 12 below.

TABLE 12

| | Composition in percent by volume | |
|---|---|---|
| | Light solvent | Heavy solvent |
| Propane | 60 | 20 |
| Butanes | 0.8 | 0.8 |
| n-Pentane | 31 | 63 |
| Isopentane | 8 | 16 |
| Hexanes | 0.2 | 0.2 |

The operative conditions are given in Table 13 below.

TABLE 13

| | Tower 102 | Tower 109 |
|---|---|---|
| Pressure (in $10^5$ pascals abs) | 40 | 40 |
| Temperature at top (°C.) | 130 | 140 |
| Temperature at bottom (°C.) | 100 | 110 |
| Mass ratio of solvent to feedstock line 101 | 2/1 | 1.8/1 |

The final balance obtained after separation of the solvent from the various products is given in Table 14 below.

TABLE 14

| | |
|---|---|
| Feedstock Line 101 (tons/day) | 2,500 |
| Resins produced Line 128 (tons/day) | 700 |
| Deasphalted oil produced Line 138 (tons/day) | 1,000 |
| Asphaltenes produced Line 13' (tons/day) | 800 |

The characteristics of the products obtained are given in Table 15 which follows.

TABLE 15

| Product | Characteristics | |
|---|---|---|
| Deasphalted oil | Density (kg/m$^3$) | 955 |
| | Viscosity at 100° C. ($10^{-6}$ m$^2$/s) | 70 |
| | Conradson residue (wt. %) | 5 |
| | Nickel (ppm) | 2 |
| | Vanadium (ppm) | 5 |
| | Asphaltenes (wt. %) | Traces |
| Resins | Density (kg/m$^3$) | 1,040 |
| | Viscosity at 100° C. ($10^{-6}$ m$^2$/s) | 2,500 |
| | Conradson residue (wt. %) | 20 |
| | Softening point (°C.) | 45 |
| Asphaltenes | Density (kg/m$^3$) | 1,150 |
| | Softening point (°C.) | 175 |
| | Conradson residue (wt. %) | 48 |

It is readily apparent from this table that the process of the invention is advantageous inasmuch as it yields very hard asphaltenes and an oil suitable for use as a catalytic cracking feedstock since it has a Conradson residue of less than 8.

What is claimed is:

1. A process for the deasphalting of a heavy hydrocarbon feedstock containing an oil phase and an asphaltic phase, the asphaltic phase containing a light resin fraction and a heavy asphaltene fraction; the process comprising a first treatment step of mixing said feedstock with a first solvent containing substantially only at least one or more hydrocarbons constituting a $C_3$ species having 3 carbon atoms and at least one or more hydrocarbons constituting a $C_{5+}$ species having at least 5 carbon atoms; the two species of hydrocarbons being present in the first solvent in a given proportion so as to yield as products of said first treatment step a precipitate including at least said asphaltene fraction and a supernatant including at least said oil phase, with said resin fraction being present only in one of said precipitate and said supernatant; separating said precipitate from said supernatant; a second treatment step of mixing that product of the first step which contains the resin fraction with a second solvent containing only at least one or more hydrocarbons constituting a $C_3$ species having three carbon atoms and at least one or more hydrocarbons constituting a $C_{5+}$ species having at least 5 carbon atoms; the two species of hydrocarbons being present in the second solvent in a given proportion different from their proportion in the first solvent such that in the event that said second solvent is mixed with said precipitate containing said resin fraction, the second solvent has fewer $C_3$ species than said first solvent and in the event that said second solvent is mixed with said supernatant containing said resin fraction the second solvent has more $C_3$ species than said first solvent; ultimately separating said solvents for recycling; the proportions of said species in said first and second solvents being such that said process yields a seperate deasphalted oil phase with a Conradson carbon value of 10 or less, a separated resin fraction, and a separate asphaltene fraction with a softening point of 150° C. or higher.

2. The process of claim 1, wherein the first and second solvents contain the same hydrocarbons and differ essentially only in the proportions thereof.

3. A process for deasphalting a heavy hydrocarbon feedstock containing an oil phase and an asphaltic phase, the asphaltic phase containing a light resin fraction and a heavy asphaltene fraction; the process comprising a first treatment step of mixing said feedstock with a first solvent containing at least one hydrocarbon having 3 carbon atoms and at least one hydrocarbon having at least 5 carbon atoms, the two kinds of hydrocarbons present in the first solvent being in a specified proportion so as to yield an oil-containing mixture with most of said first solvent and also to yield a separate asphaltene-containing mixture with a little of said first solvent, with only one of said mixtures being an interim mixture and containing resin and the other of said mixtures being the first mixture; a second treatment step of mixing said resin-containing interim mixture with a second solvent containing at least one hydrocarbon having 3 carbon atoms and at least one hydrocarbon having at least 5 carbon atoms, the two kinds of hydrocarbons present in the second solvent being in a specified proportion different from their proportion in the first solvent so as to yield a resin-containing second mixture with at least some of said second solvent and also to yield a third mixture with at least some of said second solvent and with whichever of the oil or asphaltene was present in said interim mixture; and third through fifth treatment steps to separate solvent from the first, second and third mixtures formed by the first and second treatment steps to yield three separate products derived from said feedstock including a deasphalted oil phase with a Conradson carbon value of 10 or less; a resin fraction; and an asphaltene fraction with a softening point of 150° C. or higher.

4. The process of claim 3 wherein:

(a) the first treatment step separates the asphaltene fraction from the heavy hydrocarbon feedstock as said first mixture which contains said asphaltene fraction with some first solvent and also produces as said interim mixture the separate combination of the resin fraction and oil phase in the major portion of said first solvent;

(b) the second treatment step separates the resin fraction from the interim mixture as a second mixture which contains said resin fraction with some second solvent and also produces as a third mixture the separate combination of the oil phase in the major portion of the second solvent;

(c) the third treatment step removes the first solvent from the first mixture to produce an asphaltene fraction with a softening point of 150° C. or higher;

(d) the fourth treatment step removes the second solvent from the second mixture to produce a resin fraction; and (e) the fifth treatment step removes the second solvent from the third mixture to produce a deasphalted oil phase with a Conradson carbon value of 10 or less.

5. The process of claim 4 wherein the first solvent is a heavy solvent comprising from 5 to 40 volume percent of a hydrocarbon having 3 carbon atoms and from 60 to 95 volume percent of at least one hydrocarbon having at least 5 carbon atoms; and the second solvent is a light solvent comprising from 20 to 80 volume percent of a hydrocarbon having 3 carbon atoms and from 20 to 80 volume percent of at least one hydrocarbon having at least 5 carbon atoms.

6. The process of claim 5 wherein the first solvent is a heavy solvent comprising from 15 to 35 volume percent of a hydrocarbon having 3 carbon atoms and from 65 to 85 volume percent of at least one hydrocarbon having at least 5 carbon atoms; and the second solvent is a light solvent comprising from 25 to 75 volume percent of a hydrocarbon having 3 carbon atoms and from 25 to 75 volume percent of at least one hydrocarbon having at least 5 carbon atoms.

7. The process of claim 4 wherein the first and second treatment steps include liquid extraction, the third treatment steps includes at least one flash vaporization and the fourth and fifth treatment steps each include at least one flash vaporization and steam stripping.

8. The process of claim 5 wherein the hydrocarbon having 3 carbon atoms is propane or propylene and the hydrocarbon having at least 5 carbon atoms is pentane, pentene, hexane, hexene, heptane or heptene.

9. The process of claim 8, wherein the first and second solvents contain the same hydrocarbons and differ essentially only in the proportions thereof.

10. The process of claim 5 wherein the light solvent is formed by combining heavy solvent with a third solvent that is lighter than the light solvent, the third solvent being obtained by the separation of the light solvent from the oil phase by the preferential vaporization of the hydrocarbon having 3 carbon atoms which yields the third solvent.

11. The process of claim 10 wherein the content of hydrocarbon having 3 carbon atoms in the third solvent is increased by utilizing an increased reflux during separation of the light solvent from the oil phase.

12. The process of claim 3 wherein:

(a) the first treatment step separates the asphaltic phase from the oil phase of the heavy hydrocarbon feedstock as said first mixture which contains said oil phase with the major portion of the first solvent and also produces as said interim mixture the separate combination of the asphaltic phase, containing the resin fraction and asphaltene fraction, in some of the first solvent;

(b) the second treatment step separates the asphaltene fraction from the interim mixture as a second mixture which contains said asphaltene fraction with some second solvent and also produces as a third mixture the separate combination of the resin fraction in the major portion of the second solvent;

(c) the third treatment steps removes the first solvent from the first mixture to produce an oil phase with a Conradson carbon value of 10 or less;

(d) the fourth treatment step removes the second solvent from the second mixture to produce an asphaltene fraction with a softening point of 150° C. or higher; and (e) the fifth treatment steps removes the second solvent from the third mixture to produce a resin fraction.

13. The process of claim 12 wherein the first solvent is a light solvent comprising from 20 to 80 percent by volume of a hydrocarbon having 3 carbon atoms and from 20 to 80 volume percent of at least one hydrocarbon having at least 5 carbon atoms; and the second solvent is a heavy solvent comprising from 5 to 30 volume percent of a hydrocarbon having 3 carbon atoms and from 70 to 95 volume percent of at least one hydrocarbon having at least 5 carbon atoms.

14. The process of claim 13 wherein the first solvent is a light solvent comprising from 30 to 70 volume percent of a hydrocarbon having 3 carbon atoms and from 30 to 70 volume percent of at least one hydrocarbon having at least 5 carbon atoms; and the second solvent is a heavy solvent comprising from 10 to 25 volume percent of a hydrocarbon having 3 carbon atoms and from 75 to 90 volume percent of at least one hydrocarbon having at least 5 carbon atoms.

15. The process of claim 12 wherein the first and second treatment steps include liquid extraction, the third and fifth treatment steps each include at least one flash vaporization and steam stripping and the fourth treatment step includes at least one flash vaporization.

16. The process of claim 13 wherein the hydrocarbon having 3 carbon atoms is propane or propylene and the hydrocarbon having 5 carbon atoms is pentane, pentene, hexane, hexene, heptane or heptene.

17. A process for deasphalting a heavy hydrocarbon feedstock containing an oil phase and an asphaltic phase, the asphaltic phase containing a light resin fraction and a heavy asphaltene fraction, to yield three separate principal products including a deasphalted oil phase with a Conradson carbon value of 10 or less; a resin fraction; and an asphaltene fraction with a softening point of 150° C. or higher; the process comprising a first treatment step of mixing the hydrocarbon feedstock with a first solvent containing at least one $C_3$ species of hydrocarbon having 3 carbon atoms and at least one $C_{5+}$ species of hydrocarbon having at least 5 carbon atoms, the two hydrocarbon species being present in the first solvent in a specified proportion to yield a first mixture which apart from any solvent principally contains oil and a second mixture which apart from any solvent principally contains asphaltenes, with one of said mixtures also containing resin as a second principal ingredient thereof; a second treatment step of mixing the mixture containing the resin with a second solvent containing at least one $C_3$ species of hydrcarbon having 3 carbon atoms and at least one $C_{5+}$ species of hydrocarbon having at least 5 carbon atoms, the two hydrocarbon species being present in the second solvent in a specified proportion different from their proportion in the first solvent to yield a third mixture which apart from any solvent principally contains resin and a fourth mixture which apart from any solvent principally contains the other principal ingredient derived from the mixture treated with said second solvent; and further treatment steps to separate the oil, resin and asphaltene from the solvents mixed therewith to yield said three separate products.

18. The process of claim 16, wherein the first and second solvents contain the same hydrocarbons and differ essentially only in the proportions thereof.

19. The process of claim 3, wherein the first and second solvents contain the same hydrocarbons and differ essentially only in the proportions thereof.

* * * * *